US011837390B2

(12) United States Patent
Yan et al.

(10) Patent No.: US 11,837,390 B2
(45) Date of Patent: Dec. 5, 2023

(54) R-T-B BASED PERMANENT MAGNET MATERIAL AND METHOD FOR PREPARING THE SAME

(71) Applicant: NINGBO KETIAN MAGNET CO., LTD., Zhejiang (CN)

(72) Inventors: Changjiang Yan, Zhejiang (CN); Nijian Qian, Zhejiang (CN); Wancheng Fu, Zhejiang (CN)

(73) Assignee: NINGBO KETIAN MAGNET CO., LTD., Ningbo (CN)

( * ) Notice: Subject to any disclaimer, the term of this patent is extended or adjusted under 35 U.S.C. 154(b) by 2 days.

(21) Appl. No.: 16/609,932

(22) PCT Filed: Jul. 26, 2019

(86) PCT No.: PCT/CN2019/097906
§ 371 (c)(1),
(2) Date: Oct. 31, 2019

(87) PCT Pub. No.: WO2020/119133
PCT Pub. Date: Jun. 18, 2020

(65) Prior Publication Data

US 2023/0049109 A1 Feb. 16, 2023

(30) Foreign Application Priority Data

Jul. 18, 2019 (CN) ..... 201910652042.6

(51) Int. Cl.
*H01F 1/055* (2006.01)
*H01F 41/02* (2006.01)

(52) U.S. Cl.
CPC ..... *H01F 1/0557* (2013.01); *H01F 41/0273* (2013.01)

(58) Field of Classification Search
None
See application file for complete search history.

(56) References Cited

U.S. PATENT DOCUMENTS 9,892,831 B2 * 2/2018 Hirota ..... B22F 9/023
2010/0040501 A1 * 2/2010 Kato ..... H01F 1/0577 419/38

(Continued)

FOREIGN PATENT DOCUMENTS

CN 106783128 A * 5/2017 ..... B22F 1/025
CN 108735494 A * 11/2018

OTHER PUBLICATIONS

Machine translation of CN106782138A. (Year: 2017).*
Machine translation of CN108735494A. (Year: 2018).*

*Primary Examiner* — Xiaowei Su
(74) *Attorney, Agent, or Firm* — SoCal IP Law Group LLP; Brian S. Tamsut

(57) ABSTRACT

The present invention relates to an R-T-B based permanent magnet material, having a composition of $R_xT_yTm_qB_z$ (at. %), wherein $13 \le x \le 15.5$, $0.5 \le q \le 3$, $0.85 \le z \le 1$, $y=100-x-q-z$; wherein R is $LR_aHR_{1-a}$, LR is one selected from the group consisting of Pr, Nd, PrNd, or a combination thereof, HR is one selected from the group consisting of Dy and Tb, or a combination thereof, and $0.95 \le a \le 1$; wherein T is one selected from the group consisting of Fe and Co, or a combination thereof; and Tm is a transition metal. The advantage of the method is that: plating a heavy rare earth film on alloy flakes using a magnetron sputtering device, and the coercivity of the magnet is significantly increased simply by having a "core-shell" structure without long time diffusion heat treatment.

1 Claim, 3 Drawing Sheets

(56) References Cited

U.S. PATENT DOCUMENTS

| | | | | |
|---|---|---|---|---|
| 2014/0132377 | A1* | 5/2014 | Nakajima | C22C 38/10 420/83 |
| 2018/0158583 | A1* | 6/2018 | Masusawa | C22C 38/14 |

* cited by examiner

R-T-B BASED PERMANENT MAGNET MATERIAL AND METHOD FOR PREPARING THE SAME

RELATED APPLICATION INFORMATION

This patent claims priority from International PCT Patent Application No. PCT/CN2019/097906, filed Jul. 26, 2019 entitled, "R-T-B BASED PERMANENT MAGNET MATERIAL AND METHOD FOR PREPARING THE SAME", which claims priority to Chinese Patent Application No. 201910652042.6, filed Jul. 18, 2019 all of which are incorporated herein by reference in their entirety.

BACKGROUND OF THE INVENTION

1. Field of the Invention

The invention relates to the technical field of preparation of rare earth magnetic materials, and more particularly, to an R-T-B based permanent magnet material and a method for preparing the same.

2. Description of the Related Art

As the third generation of rare earth permanent magnet materials, NdFeB permanent magnet materials have high energy products. Thus, NdFeB makes the motors smaller, lighter, and more efficient. At present, permanent magnet motors have been used in electric vehicles, hybrid electric vehicles and energy-saving air-conditioner compressor. In those applications, magnet operating temperature is relatively high, generally between 120° C. and 200° C. Therefore, only when the coercivity of magnets is improved can processes be done in a high-temperature environment.

The conventional process for preparing sintered NdFeB permanent magnets comprises strip casting, hydrogen decrepitation, jet milling, magnetic field orientation, sintering and annealling etc. In this process, the main way to increase the coercivity is adding heavy rare earth into raw materials. Such a method is easy to implement during production process. However, the addition of magnets of high coercivity will result in a deteriorated remanence. For example, for conventional commercially available magnet grade 42SH, 2-3 wt % Dy needs to be added. In general, the coercivity is increase by 2 kOe, and the remanence is decreased by 0.2 kOe to 0.3 kOe for the addition of per 1 wt % Dy. Another major problem for this process is that it is impossible to produce a magnet with high energy product and high coercivity, for example a magnet with a high energy product of 48 MGOe and a high coercivity of 20 kOe or more. As a result, this may limit the application of NdFeB permanent magnets in devices where properties of light weight and high efficiency are required. The addition of heavy rare earth in large quantities not only fails to make a balance between remanence and coercivity, but also increases the costs of magnet.

At present, during the research & development of grain boundary diffusion technique, above-mentioned drawbacks are effectively avoided, and such a technique has become a hot spot issue in the research field of rare earth permanent magnet. Grain boundary diffusion technique is all about performing all kinds of specific processes, such as evaporation (H. Sepehri-Amin, T Ohkubo, and K. Hono, *Grain boundary structure and chemistry of Dy-diffusion processed Nd—Fe—B sintered magnets JOURNAL OF APPLIED PHYSICS* 107, 09A745_2010), magnetron sputtering (BinghuiWu, Xuefeng Ding, Qingke Zhang et. al, *The dual trend of diffusion of heavy rare earth elements during the grain boundary diffusion process for sintered Nd—Fe—B magnets, Scripta Materialia* 148 (2018) 29-32), surface coating (Deshan L I, Shunji SUZUKI, Takashi KAWASAKI et. al, *Grain Interface Modification and Magnetic Properties of Nd—Fe—B Sintered Magnets, Japanese Journal of Applied Physics Vol.* 47, No. 10, 2008, pp. 7876-7878), and other processes. In those processes, Dy or Tb is attached to a surface of the magnet and then is subjected to thermal diffusion treatment. After the magnet is subjected to grain boundary diffusion process, the coercivity is increase by 6 kOe to 10 kOe, and the remanence is substantially not decreased. In this way, it is allowed to prepare a magnet with a high energy product of 48 MGOe and a high coercivity of about 25 kOe while the magnet has a small percentage of heavy rare earth. This technique has been partially used in thinner products, such as magnet having a thickness in a range from 1.5 μm to 3 μm, which are used in a motor of an inverter air-conditioner compressor. However, such a method has some limitations. The technique is completed by using a magnet having full density by sintering process; after heavy rare earth source is arranged on the surface, long-term diffusion ageing treatment needs to be done, whereby, its cycle for production of the magnet is relatively long. During the process, since the heavy rare earth diffuses inward from the surface along the grain boundary, its diffusion depth is limited. Thus, only thinner magnets may be produced, leading to a poor consistency in terms of the coercivity of the magnet.

It is therefore in need of a permanent magnet with high performance and high coercivity and a method for preparing the same, wherein the amount of rare earth is reduced.

SUMMARY OF THE INVENTION

Given that the foregoing shortages exist in the prior art, the present invention provides an R-T-B based permanent magnet material and a method for preparing the same.

A first object of the present invention is to provide an R-T-B based permanent magnet material.

An R-T-B based permanent magnet material, having a composition of $R_xT_yTm_qB_z$ (at. %), wherein $13 \le x \le 15.5$, $0.5 \le q \le 3$, $0.85 \le z \le 1$, $y=100-x-q-z$;

wherein R is $LR_aHR_{1-a}$, LR is selected from the group consisting of Pr, Nd, PrNd, or a combination thereof, HR is one selected from the group consisting of Dy and Tb, or a combination thereof, and $0.95 \le a \le 1$;

wherein T is one selected from the group consisting of Fe and Co, or a combination thereof; and Tm is a transition metal.

Preferably, Tm is one selected from the group consisting of Zr, Al, Cu, Ga, Sn, Si, or a combination thereof.

Preferably, a main phase crystal grain of the R-T-B based permanent magnet material is a "core-shell" structure.

Preferably, HR has higher concentration in the shell than in the core.

A second object of the present invention is to provide a method for preparing an R-T-B based permanent magnet material.

A method for preparing an R-T-B based permanent magnet material, comprising the steps of:

Step S1, preparing raw materials according to $R_xT_yTm_qB_z$, wherein $13 \le x \le 15.5$, $0.5 \le q \le 3$, $0.85 \le z \le 1$, $y=100-x-q-z$;

Step S2, adding the raw materials to a vacuum smelting device for smelting and casting, so as to obtain first alloy flakes;

Step S3, plating a heavy rare earth film on the first alloy flakes to obtain second alloy flakes;

Step S4, coarsely crushing and grinding the second alloy flakes to obtain fine powder;

Step S5, granulating the fine powder and performing compression molding, so as to obtain a green compact; and Step S6, performing diffusion sintering and multi-stage anneallling on the green compact to obtain the R-T-B based permanent magnet material.

Preferably, in Step S1, wherein R is $LR_aHR_{1-a}$, LR is one selected from the group consisting of Pr, Nd, PrNd, or a combination thereof, HR is one selected from the group consisting of Dy and Tb, or a combination thereof;

and $0.95 \leq a \leq 1$;

Preferably, Tm is a transition metal, and Tm is one selected from the group consisting of Zr, Al, Cu, Ga, Sn, Si, or a combination thereof.

Preferably, in Step S2, the raw materials are smelted under an inert gas atmosphere;

the raw materials are casted at a temperature of 1400° C.-1500° C. after being subjected to the smelting process.

Preferably, the inert gas is Ar or He.

Preferably, the first alloy flakes have a thickness in a range from 200 μm to 300 μm.

Preferably, in Step S3, the heavy rare earth film is made from a material selected from the group consisting of Dy and Tb, or a combination thereof.

Preferably, in Step S3, the heavy rare earth film has a thickness in a range from 0 μm to 3 μm.

Preferably, in Step S3, plating the heavy rare earth film on the first alloy flakes using a magnetron sputtering device.

Preferably, in Step S3, a target material used in the magnetron sputtering device is one selected from the group consisting of Tb, Dy, and HRE-X alloy.

Preferably, in the HRE-X alloy, HRE is one selected from the group consisting of Tb and Dy, or a combination thereof;

X is one selected from the group consisting of Fe, Cu, or a combination thereof.

Preferably, a main phase crystal grain of the R-T-B based permanent magnet material is a "core-shell" structure;

HR has higher concentration in the shell than in the core.

Preferably, in Step S4, the method further comprises:

Step S41, coarsely crushing the second alloy flakes to obtain coarse powder, wherein the following conditions for coarse crushing should be met: the second alloy flakes are dehydrogenized at a temperature of 350° C.-500° C. after it is sufficiently reacted in a mixed gas of $H_2$ and Ar;

Step S42, grinding the coarse powder obtained in Step S41 to obtain the fine powder, wherein the following conditions for grinding should be met: high-speed grinding operation is performed in a mixed gas of $N_2$ and $O_2$, and the grain size of the fine powder is in a range from 1 μm to 4 μm.

Preferably, in Step S5, the method further comprises:

Step S51, mixing and stirring the fine powder and organic matter to obtain a mixture; and Step S52, placing the mixture obtained from Step S51 into $N_2$, to perform magnetic field aligning and pressing, so as to obtain the green compact.

Preferably, in Step S6, the following conditions for diffusion sintering should be met:

the green compact is kept at 1000° C.-1055° C. for 6 hours to 10 hours.

Preferably, in Step S6, the following conditions for multi-stage annealing should be met:

the first stage of annealing: the green compact is kept at 850° C.-950° C. for 2 hours to 3 hours; and the second stage of annealing: the green compact is kept at 450° C.-580° C. for 1 hour to 5 hours.

By adopting the above-mentioned technical solutions, the present invention has the following advantageous effects as compared to the prior art.

The present invention provides an R-T-B based permanent magnet material and a method for preparing the same. In this method, plating a heavy rare earth on a first alloy flakes film using a magnetron sputtering device, then performing coarse crushing, grinding fine powder, orientation molding, diffusion sintering and multi-stage annealing and other processes to obtain a sintered NdFeB permanent magnets. Compared with grain boundary diffusion, the whole preparation process is relatively simple and the coercivity of the magnet is significantly increased simply by having a "core-shell" structure without long time diffusion heat treatment (which means only a short time of diffusion heat treatment is required), and the process is not limited by the diffusion depth. Compared with conventional process, a higher coercivity and a higher energy product may be obtained in the presence of the same amount of heavy rare earth by using the process provided in the present invention, and the reason for such an outcome is listed as follows: the heavy rare earth may be uniformly distributed after the cast plate plated with heavy rare earth film is crushed; heavy rare earth elements diffuse inward from a surface of the magnet and form a shell layer rich in heavy rare earth along the periphery of the main phase crystal grain of each $Nd_2Fe_{14}B$, such that formation of a demagnetization core and entry of excessive heavy rare earth into the main phase may be avoided, and a hard magnetic phase grain having a "core-shell" structure is formed.

BRIEF DESCRIPTION OF THE DRAWINGS

The accompanying drawings, together with the specification, illustrate exemplary embodiments of the present disclosure, and, together with the description, serve to explain the principles of the present invention.

Figure 1:
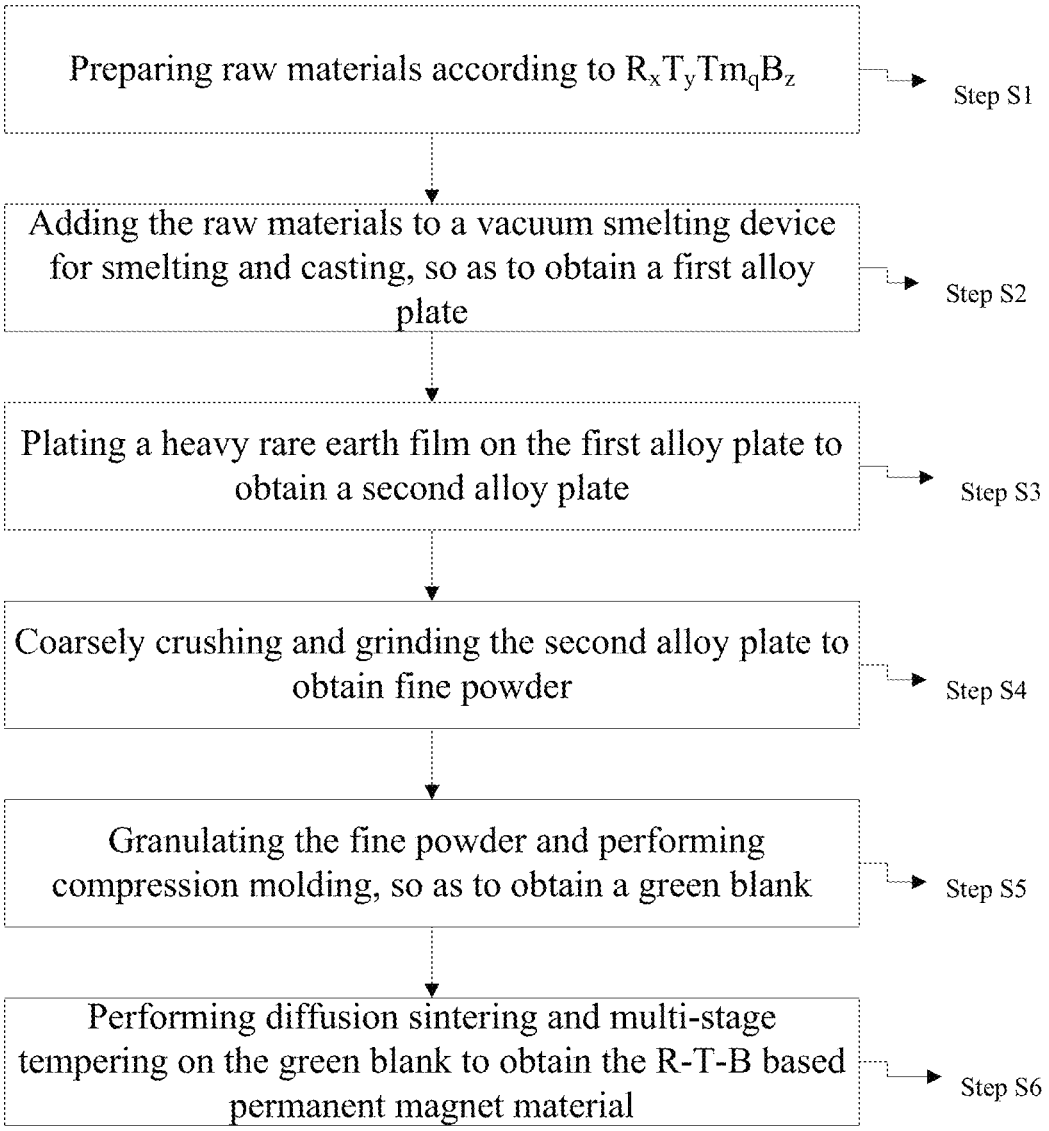
FIG. 1 is flowchart illustrating a process for preparing an R-T-B based permanent magnet material according to an exemplary embodiment of the present invention.

Reference numerals in the drawings: 1. Cleaning chamber, 2. Film plating chamber, 3. Primary cooling chamber, 4. Secondary cooling chamber, 5. First alloy flake, 6. Heavy rare earth or its alloy target, 7. Transmission roller.

DETAILED DESCRIPTION

The present invention will now be described more fully hereinafter with reference to the accompanying drawings, in which exemplary embodiments of the invention are shown.

This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the term "plurality" means a number greater than one.

Hereinafter, certain exemplary embodiments according to the present disclosure will be described with reference to the accompanying drawings.

Example 1

As shown in FIG. 1, the present invention provides a method for preparing an R-T-B based permanent magnet material, comprising the steps of:

Step S1, preparing raw materials according to $R_xT_yTm_qB_z$, wherein $13 \le x \le 15.5$, $0.5 \le q \le 3$, $0.85 \le z \le 1$, $y=100-x-q-z$;

Step S2, adding the raw materials to a vacuum smelting device for smelting and casting, so as to obtain first alloy flakes;

Step S3, plating a heavy rare earth film on the first alloy flakes to obtain second alloy flakes;

Step S4, coarsely crushing and grinding the second alloy flakes to obtain fine powder;

Step S5, granulating the fine powder and performing compression molding, so as to obtain a green compact; and Step S6, performing diffusion sintering and multi-stage annealing on the green compact to obtain the R-T-B based permanent magnet material.

The steps described above are basic steps for obtaining the R-T-B based permanent magnet material.

Wherein, in Step S1, R is $LR_aHR_{1-a}$, LR is one selected from the group consisting of Pr, Nd, PrNd, or a combination thereof, HR is one selected from the group consisting of Dy and Tb, or a combination thereof; and $0.95 \le a \le 1$.

Wherein, Tm is a transition metal, and Tm is one selected from the group consisting of Zr, Al, Cu, Ga, Sn, Si, or a combination thereof.

Furthermore, in Step S2, the raw materials are smelted under an inert gas.

Furthermore, the raw materials are casted at a temperature of 1400° C.-1500° C. after being subjected to the smelting process.

Furthermore, the inert gas is Ar or He.

Furthermore, the first alloy flakes have a thickness in a range from 200 μm to 300 μm.

Furthermore, in Step S3, the heavy rare earth film is made from a material selected from the group consisting of Dy and Tb, or a combination thereof.

Furthermore, in Step S3, the heavy rare earth film has a thickness in a range from 0 μm to 3 μm.

Furthermore, in Step S3, plating the heavy rare earth film on the first alloy flakes using a magnetron sputtering device.

Furthermore, in Step S3, a material used in the magnetron sputtering device is one selected from the group consisting of Tb, Dy, and HRE-X alloy, or a combination thereof.

Wherein, in the HRE-X alloy, HRE is one selected from the group consisting of Tb and Dy, or a combination thereof.

X is one selected from the group consisting of Fe, Cu, or a combination thereof.

Furthermore, a main phase crystal grain of the R-T-B based permanent magnet material is a "core-shell" structure.

Figure 2:
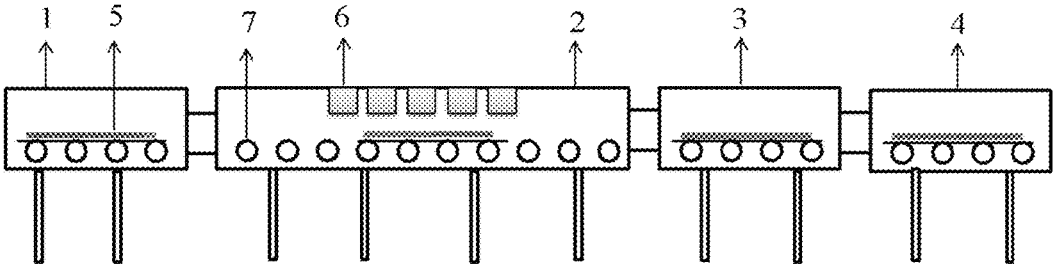
FIG. 2 is a schematic view showing a magnetron sputtering device according to an exemplary embodiment of the present invention.

Furthermore, as shown in FIG. 2, the magnetron sputtering device sequentially comprises a cleaning chamber 1, a film plating chamber 2, a primary cooling chamber 3 and a secondary cooling chamber 4, wherein heavy rare earth or its alloy target 6 is arranged above an interior of the film plating chamber 2 for plating the heavy rare earth on the first alloy flakes 5 in the film plating chamber 2. The cleaning chamber 1, the film plating chamber 2, the primary cooling chamber 3 and the secondary cooling chamber 4 are provided with transmission rollers 7 for conveying the first alloy flakes 5.

Furthermore, in Step S4, the method further comprises:

Step S41, coarsely crushing the second alloy flakes to obtain coarse powder, wherein the following conditions for coarse crushing should be met: the second alloy flakes are dehydrogenized at a temperature of 350° C.-500° C. after it is sufficiently reacted in a mixed gas of $H_2$ and Ar;

Step S42, grinding the coarse powder obtained in Step S41 to obtain the fine powder, wherein the following conditions for grinding should be met: high-speed grinding operation is performed in a mixed gas of $N_2$ and $O_2$, and the grain size varies of the fine powder is in a range from 1 μm to 4 μm.

Furthermore, in Step S41, hydrogenation is performed in a mixed gas of $H_2$ and Ar at a temperature of 200° C.-450° C.

Furthermore, in Step S41, dehydrogenation is performed at a temperature of 420° C.-500° C.

Furthermore, in Step S5, the method further comprises:

Step S51, mixing and stirring the fine powder and organic matter to obtain a mixture; and Step S52, placing the mixture obtained from Step S51 into $N_2$, to perform magnetic field orientation molding, so as to obtain the green compact.

Wherein, the organic matter acts to prevent oxidation of the fine powder.

Furthermore, in Step S52, the orientation magnetic field of the green compact is in a range from 1.5 T to 2 T, and the green compact has a density of 3.5-4.1 g/cm$^3$.

Furthermore, in the orientation molding process, the pressure comes in a direction parallel to the direction of magnetic field, or the pressure comes in a direction perpendicular to the direction of magnetic field.

Furthermore, in Step S6, the following conditions for diffusion sintering should be met:

the green compact is kept at 1000° C.-1055° C. for 6 hours to 10 hours.

Furthermore, in Step S6, the following conditions for multi-stage annealing should be met:

the first stage of annealing: the green compact is kept at 850° C.-950° C. for 2 hours to 3 hours; and the second stage of annealing: the green compact is kept at 450° C.-580° C. for 1 hour to 5 hours.

Example 2

This example is a specific embodiment of the R-T-B based permanent magnet material according to the present invention.

The preparation method for this embodiment is as follows:

In Step S1, raw materials are prepared in a ratio as shown in table 1.

TABLE 1

Table of Raw Material Ingredients (at. %)

| | Pr | Nd | Dy | Tb | Al | Cu | Ga | Zr | Fe | Co | B |
|---|---|---|---|---|---|---|---|---|---|---|---|
| Alloy 1 | 3.53 | 10.35 | 0.00 | 0.00 | 0.25 | 0.15 | 0.30 | 0.12 | Bal. | 1.00 | 5.40 |
| Alloy 2 | 3.48 | 10.19 | 0.20 | 0.00 | 0.73 | 0.21 | 0.47 | 0.07 | Bal. | 1.11 | 5.50 |
| Alloy 3 | 3.26 | 9.57 | 1.21 | 0.00 | 0.49 | 0.10 | 0.38 | 0.11 | Bal. | 1.12 | 5.42 |
| Alloy 4 | 3.26 | 9.57 | 1.33 | 0.00 | 1.22 | 0.21 | 0.38 | 0.12 | Bal. | 1.12 | 5.42 |
| Alloy 5 | 0.00 | 13.18 | 0.00 | 0.41 | 0.48 | 0.21 | 0.09 | 0.07 | Bal. | 0.55 | 5.68 |

In Step S2, the prepared raw materials are added to the vacuum smelting device for smelting and casting, so as to obtain first alloy flakes.

Wherein, the raw materials are smelted under an Ar or He atmosphere and cast onto a water-cooled copper roller having a linear velocity of 1 m/s at a temperature of 1460° C.-1470° C., to obtain the first alloy flakes having a thickness of about 300 μm.

In Step S3, plating the heavy rare earth film on the first alloy flakes according to the conditions shown in the following table 2, so as to obtain a second alloy plate.

TABLE 2

Conditions for Plating Heavy Rare Earth Film

| | Alloy | Target material | Film thickness (μm) |
|---|---|---|---|
| Example 1 | Alloy 1 | Dy | 0.5 |
| Example 2 | Alloy 2 | Dy | 0.5 |
| Example 3 | Alloy 3 | Dy | 0.5 |
| Example 4 | Alloy 4 | Dy | 0.5 |
| Example 5 | Alloy 5 | Dy | 0.5 |
| Example 6 | Alloy 1 | $Dy_{85}$-$Fe_{15}$ | 1.5 |
| Example 7 | Alloy 2 | $Dy_{85}$-$Fe_{15}$ | 1.5 |
| Example 8 | Alloy 3 | $Dy_{85}$-$Fe_{15}$ | 1.5 |
| Example 9 | Alloy 1 | Tb | 1 |
| Example 10 | Alloy 2 | Tb | 1 |
| Example 11 | Alloy 3 | Tb | 1 |
| Example 12 | Alloy 4 | Tb | 1 |

TABLE 2-continued

Conditions for Plating Heavy Rare Earth Film

| | Alloy | Target material | Film thickness (μm) |
|---|---|---|---|
| Example 13 | Alloy 5 | Tb | 1 |
| Example 14 | Alloy 1 | $Tb_{75}$-$Cu_{25}$ | 2 |
| Example 15 | Alloy 2 | $Tb_{75}$-$Cu_{25}$ | 2 |

In Step S3, the specific process is as follows:

The first alloy flakes 5 are transmitted to the cleaning chamber 1 for performing ion cleaning on a surface of the first alloy flakes 5; the cleaned first alloy flakes 5 are transmitted into the film plating chamber 2 for plating the heavy rare earth film on the first alloy flakes 5 at a preset current of sputtering of the target material and a preset time; and the first alloy flakes 5 is sequentially transmitted into the primary cooling chamber 3 and the secondary cooling chamber 4 for cooling.

In Step S4, the second alloy flakes are coarsely crushed and grinded to obtain fine powder.

Wherein, the following conditions for coarse crushing should be met: the second alloy flakes are hydrogenized in a mixed gas of $H_2$ and Ar at a temperature of 200° C.-450° C. and then is dehydrogenized at a temperature of 450° C., so as to obtain coarse powder with a grain size in a range from 200 μm to 500 μm.

Wherein, the grain size of the fine powder after grinding is shown in the following table 3.

TABLE 3

Grain Size for Fine Powder

| | Grain size |
|---|---|
| Example 1 | 2.8 |
| Example 2 | 2.5 |
| Example 3 | 2.6 |
| Example 4 | 2.1 |
| Example 5 | 2.2 |
| Example 6 | 2.8 |
| Example 7 | 2.5 |
| Example 8 | 2.6 |
| Example 9 | 2.8 |
| Example 10 | 2.5 |
| Example 11 | 2.6 |
| Example 12 | 2.1 |
| Example 13 | 2.2 |
| Example 14 | 2.8 |
| Example 15 | 2.5 |

In Step S5, granulating the fine powder and performing compression molding, so as to obtain a green compact.

In Step S6, performing diffusion sintering and multi-stage annealing on the green compact to obtain the R-T-B based permanent magnet material.

Specifically, conditions for diffusion sintering are shown in Table 4.

TABLE 4

| Conditions for Diffusion Sintering | | |
|---|---|---|
| | Temperature (° C.) | Time (h) |
| Example 1 | 1055 | 8 |
| Example 2 | 1050 | 8 |
| Example 3 | 1045 | 8 |
| Example 4 | 1000 | 8 |
| Example 5 | 1010 | 8 |
| Example 6 | 1045 | 8 |
| Example 7 | 1040 | 8 |
| Example 8 | 1035 | 8 |
| Example 9 | 1055 | 8 |
| Example 10 | 1050 | 8 |
| Example 11 | 1045 | 8 |
| Example 12 | 1040 | 8 |
| Example 13 | 1055 | 8 |
| Example 14 | 1045 | 8 |
| Example 15 | 1040 | 8 |

During the diffusion sintering process, Dy or Tb migrated among crystal grains, and a displacement reaction occurs between Dy or Tb and $Nd_2Fe_{14}B$ of the main phase in the permanent magnet material, wherein, the reaction formula is $HRE+Nd_2Fe_{14}B \rightarrow (Nd, HRE)_2Fe_{14}B+Nd$. Thus, the heavy rare earth may be uniformly distributed and form a "core-shell" structure as expected.

Furthermore, in this embodiment, the diffusion sintering process is a low temperature sintering process.

The multi-stage annealing is a secondary annealing, and the conditions are as follows:

the first stage of annealing: the green compact is kept at 900° C. for 2 hours; and the second stage of annealing: the green compact is kept at 500° C. for 4 hours.

Example 3

This example is a comparative example of the R-T-B based permanent magnet material according to the present invention.

The preparation method for the comparative example is as follows:

In Step S1, raw materials are made from the alloy 2 and the alloy 5 in a ratio as shown in table 1.

In Step S2, the prepared raw materials are added to the vacuum smelting device for smelting and casting, so as to obtain first alloy flakes.

Wherein, the raw materials are smelted under an Ar or He atmosphere and cast onto a water-cooled copper roller having a linear velocity of 1 m/s at a temperature of 1460° C.-1470° C., to obtain the first alloy flakes having a thickness of about 300 μm.

Step S3 is omitted in the comparative example.

In Step S4, the second alloy flakes are coarsely crushed and grinded to obtain fine powder.

Wherein, the following conditions for coarse crushing should be met: the second alloy flakes are hydrogenized in a mixed gas of $H_2$ and Ar at a temperature of 200° C.-450° C. and then is dehydrogenized at a temperature of 450° C., so as to obtain coarse powder having a grain size in a range from 200 μm to 500 μm.

Wherein, the grain size of the fine powder is shown in the following table 5.

TABLE 5

| Grain Size for Fine Powder | |
|---|---|
| | Grain size |
| Comparative example 1 | 2.6 |
| Comparative example 2 | 2.6 |

In Step S5, granulating the fine powder and performing compression molding, so as to obtain a green compact.

In Step S6, performing diffusion sintering and multi-stage annealing on the green compact to obtain the R-T-B based permanent magnet material.

Specifically, conditions for diffusion sintering are shown in Table 6.

TABLE 6

| Conditions for Diffusion Sintering | | |
|---|---|---|
| | Temperature (° C.) | Time (h) |
| Comparative example 1 | 1050 | 8 |
| Comparative example 2 | 1055 | 8 |

Furthermore, in this embodiment, the diffusion sintering process is a low temperature sintering process.

The multi-stage annealing is a secondary annealing, and the conditions are as follows:

the first stage of annealing: the green compact is kept at 900° C. for 2 hours; and the second stage of annealing: the green compact is kept at 500° C. for 4 hours.

Example 4

This example relates to performance tests of experimental examples of the example 2 and comparative examples of the example 3.

Performance tests are performed on 15 experimental examples and 2 comparative examples using a hysteresis loop analyzer. Elemental analysis is performed on 15 experimental examples and 2 comparative examples using a plasma spectrometer. The test results are shown in Table 7.

TABLE 7

| Test Results | | | | | |
|---|---|---|---|---|---|
| | Alloy | Br (kGs) | Hcj (kOe) | (BH) m | ΔHRE(wt. %) |
| Example 1 | Alloy 1 | 14.15 | 19.36 | 49.35 | 0.19 |
| Example 2 | Alloy 2 | 14.02 | 21.74 | 48.66 | 0.20 |
| Example 3 | Alloy 3 | 13.18 | 26.43 | 41.59 | 0.19 |
| Example 4 | Alloy 4 | 12.45 | 30.15 | 38.58 | 0.17 |
| Example 5 | Alloy 5 | 13.95 | 22.73 | 49.25 | 0.18 |
| Example 6 | Alloy 1 | 14.05 | 21.91 | 48.76 | 0.43 |
| Example 7 | Alloy 2 | 13.92 | 23.56 | 49.34 | 0.42 |
| Example 8 | Alloy 3 | 13.02 | 28.76 | 40.57 | 0.41 |
| Example 9 | Alloy 1 | 14.09 | 24.72 | 49.02 | 0.36 |
| Example 10 | Alloy 2 | 13.94 | 26.38 | 49.56 | 0.38 |
| Example 11 | Alloy 3 | 13.08 | 31.67 | 42.39 | 0.36 |
| Example 12 | Alloy 4 | 12.34 | 35.64 | 39.21 | 0.37 |
| Example 13 | Alloy 5 | 13.90 | 27.28 | 47.68 | 0.39 |
| Example 14 | Alloy 1 | 14.01 | 27.38 | 46.75 | 0.72 |
| Example 15 | Alloy 2 | 13.91 | 27.96 | 44.89 | 0.67 |

TABLE 7-continued

| Test Results | | | | | |
|---|---|---|---|---|---|
| | Alloy | Br (kGs) | Hcj (kOe) | (BH) m | ΔHRE(wt. %) |
| Comparative Example 1 | Alloy 2 | 14.10 | 18.90 | 48.96 | 0.00 |
| Comparative Example 2 | Alloy 5 | 14.04 | 20.65 | 48.70 | 0.00 |

It is known from table 7 that the coercivity of the permanent magnet material can be effectively improved, and the remanence drop may be within 0.2 kG by plating the heavy rare earth on the first alloy flakes.

Referring to alloy 2, for examples 2, 7, 10, 15 and comparative example 1, when 0.5 μm Dy is plated, the coercivity is increased by 2.84 kOe, and the remanence is decreased by 0.08 kGs; when Dy—Fe is plated, the coercivity is increased by 4.66 kOe, and the remanence is decreased by 0.18 kGs; when Tb is plated, the coercivity is increased by 7.48 kOe, and the remanence is decreased by 0.16 kGs; when Tb—Cu is plated, the coercivity is increased by 9.06 kOe, and the remanence is decreased by 0.19 kGs. As can be seen from the above examples, when the Tb target is used, the coercivity is increased significantly and the remanence drop is within 0.2 kGs.

Referring to alloy 5, for examples 5, 13 and comparative example 2, when Dy is plated, the coercivity is increased by 2.08 kOe, and the remanence is decreased by 0.09 kGs; when Tb is plated, the coercivity is increased by 6.63 kOe, and the remanence is decreased by 0.14 kGs.

Furthermore, when comparing the experimental example 1 and the comparative example 1, it is known that both the remanence and the coercivity of the magnet in the experimental example 1 are higher than those in the comparative example 1 in the case where the Dy content is similar both in these two examples, since after subjected to the film plating process and the diffusion sintering process, distribution of the heavy rare earth is changed, thus the remanence and the coercivity is improved.

Figure 3:
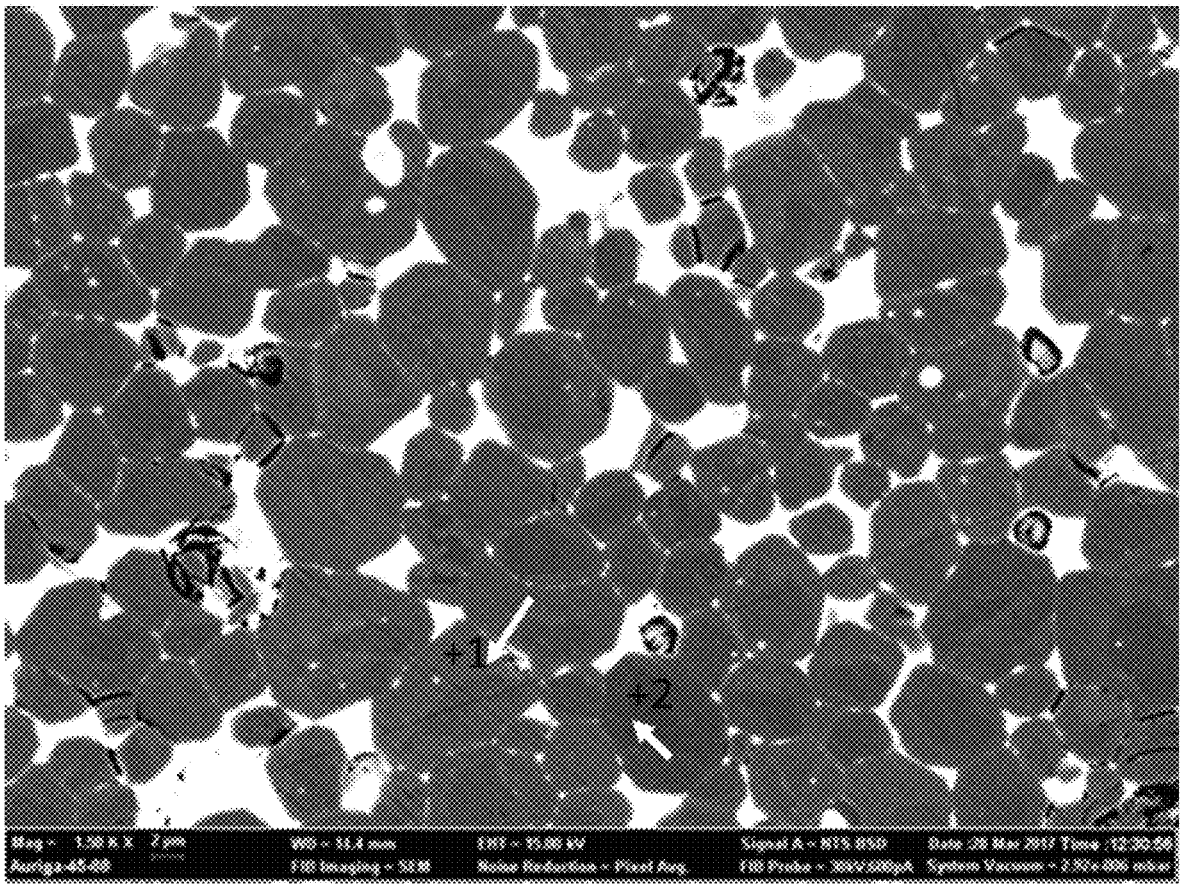
FIG. 3 is a backscattered electron image of an R-T-B based permanent magnet material according to an invention example 2 of the present invention.
Figure 4:
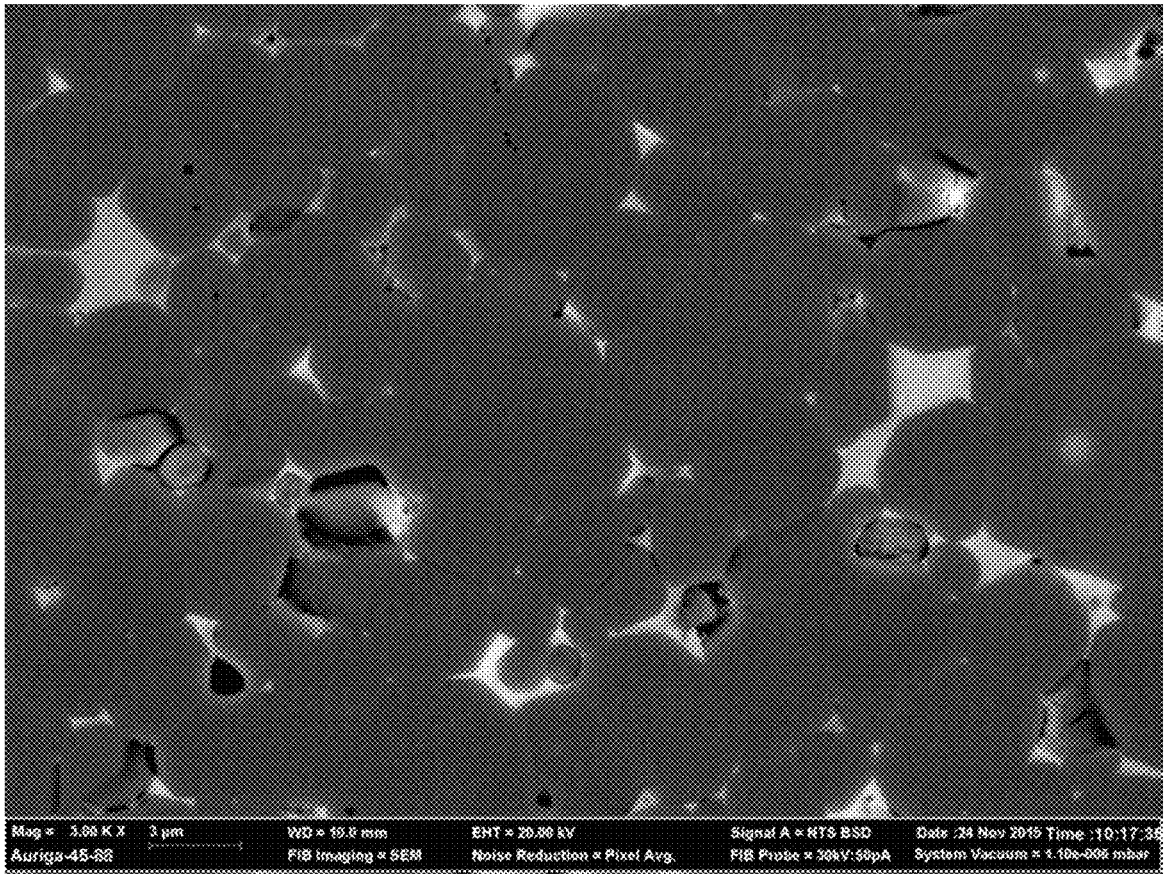
FIG. 4 is a backscattered electron image of a permanent magnet material according to a comparative example 1 of the present invention.

FIGS. 3 and 4 are backscattered electron images of R-T-B based permanent magnet materials which belong to the experimental example 2 and the comparative example 1, respectively, wherein gray areas are 2-14-1 phase particles, and gray contrast is electron concentration. In FIG. 3, two kinds of gray contrasts may be observed, namely, light gray at positions indicated by +1 and dark gray at positions indicated by +2. Wherein, light gray represents a higher electron concentration, and dark gray represents a lower electron concentration, that is, the heavy rare earth is not uniformly distributed and shows a core-shell" structure. In FIG. 4, there is only one gray contrast, that is, the heavy rare earth is uniformly distributed. As can be seen in FIG. 3, the heavy rare earth is mainly distributed along the crystal grain boundary, in other words, the heavy rare earth has higher concentration in the shell than in the core, that is, the heavy rare earth is distributed in the "shell" of the "core-shell" structure. In this way, the magnetocrystalline anisotropy field at the crystal grain boundary is increased, the probability of demagnetization of the crystal grain boundary is reduced, thereby, the coercivity of the permanent magnet material is increased.

Based on the above-mentioned test results, the following conclusion can be made. In a method for preparing a R-T-B based permanent magnet material, plating a layer of heavy rare earth film on first alloy flakes using a magnetron sputtering device to obtain second alloy flakes; then performing coarse crushing on the second alloy flakes, such that the heavy rare earth may be uniformly distributed, and heavy rare earth elements diffuse from the exterior to the interior of powder grains during the diffusion sintering process; and the heavy rare earth elements form a shell layer rich in heavy rare earth along the peripheries of the main phase crystal grains of all $Nd_2Fe_{14}B$, such that a hard magnetic phase grain having a "core-shell" structure is formed. As a result, formation of a demagnetization core and entry of excessive heavy rare earth into the main phase may be avoided. Thereby, the coercivity of the R-T-B based permanent magnet material is significantly increased, and an R-T-B based permanent magnet material with a high energy product and a highcoercivity, may be obtained.

The above descriptions are only the preferred embodiments of the invention, not thus limiting the embodiments and scope of the invention. Those skilled in the art should be able to realize that the schemes obtained from the content of specification and drawings of the invention are within the scope of the invention.

What is claimed is:

1. A method for preparing an R-T-B based permanent magnet material, comprising the steps of:

Step S1, preparing raw materials according to $R_xT_yTm_qB_z$, wherein $13 \le x \le 15.5$, $0.5 \le q \le 3$, $5.4 \le z \le 5.68$, $y=100-x-q-z$, wherein the unit for x, y, z and q is by atomic %; wherein T is one selected from the group consisting of Fe and Co, or a combination thereof;

wherein R is $LR_aHR_{1-a}$, LR is at least one selected from the group consisting of Pr, Nd, and PrNd, and HR is at least one selected from the group consisting of Dy and Tb, $0.95 \le a \le 1$;

wherein Tm is a transition metal;

Step S2, adding the raw materials to a vacuum smelting device for smelting and casting, so as to obtain first alloy flakes;

Step S3, plating a heavy rare earth film on the first alloy flakes to obtain second alloy flakes, coarse crushing the second alloy flakes to obtain coarse powder, wherein the coarse powder has a size of 200-500 μm;

wherein the following conditions for the coarse crushing step should be met: the second alloy flakes are dehydrogenized at a temperature of 350° C.-500° C. after they are reacted in a mixed gas of $H_2$ and Ar;

Step S4, grinding the coarse powder to obtain a fine powder wherein the following conditions for the grinding step should be met: grinding operation is performed in a mixed gas of $N_2$ and $O_2$, and the grain size of the fine powder is in a range from 1 μm to 4 μm;

Step S5, granulating the fine powder and performing compression molding, so as to obtain a green compact; and Step S6, performing diffusion sintering and multi-stage annealing on the green compact to obtain the R-T-B based permanent magnet material.

* * * * *